United States Patent [19]

Anderson

[11] 3,931,601

[45] Jan. 6, 1976

[54] RECEPTACLE DEVICE GROUND FAULT CIRCUIT INTERRUPTER

[75] Inventor: Richard W. Anderson, Manitowoc, Wis.

[73] Assignee: AMF Incorporated, White Plains, N.Y.

[22] Filed: Nov. 27, 1974

[21] Appl. No.: 527,823

[52] U.S. Cl. ..... 335/18; 317/18 D; 335/202

[51] Int. Cl.[2] ..... H01H 83/04

[58] Field of Search ..... 317/18 D; 335/18, 19, 202

[56] References Cited

UNITED STATES PATENTS

| | | | |
|---|---|---|---|
| 1,995,894 | 3/1935 | McNairy | 335/18 X |
| 2,809,251 | 10/1957 | Findley | 335/18 |
| 3,440,579 | 4/1969 | Smith | 335/18 |
| 3,872,355 | 3/1975 | Klein et al. | 317/18 D |

*Primary Examiner*—G. Harris

*Attorney, Agent, or Firm*—George W. Price; John H. Gallagher

[57] ABSTRACT

A duplex receptacle model GFCI device having preformed bus conductors of generally U-shaped configuration disposed on edge and one nested within the other preformed clip receptacles and support means for circuit breaker contacts are integral with the preformed bus conductors and form respective unitary conductors which are placed edgewise into slots molded into the case of the device.

13 Claims, 7 Drawing Figures

RECEPTACLE DEVICE GROUND FAULT CIRCUIT INTERRUPTER

BACKGROUND OF THE INVENTION

In recent years considerable interest has been shown in ground fault circuit interrupter (GFCI) devices that provide additional protection to humans against electrical shock which may occur because of faults in electrical equipment and in electrical supply and distribution systems. GFCI protection devices have been constructed in a form suitable for mounting in the conventional circuit breaker panel box at the input to the electrical distribution system of a residence, for example. GFCI protection devices also are provided in the form of a duplex receptacle model which replaces the conventional two receptacle electrical outlet commonly mounted in a box at the lower portion of a wall. The receptacle model GFCI commonly provides two electrical outlet receptacles, and also houses the GFCI electronics and circuit breaker means for detecting a fault condition and for interrupting the supply circuit upon detection of a fault condition.

At the present time the installation of many duplex receptacle model GFCI devices is in the nature of a retrofit of existing receptacles and therefore must physically fit within existing standard mounting boxes. Because the present standard mounting boxes were made in a size to accomodate only the two plug receptacles and the necessary wire connections thereto, the space available in a box is quite restricted for accommodating a receptacle model GFCI having included therewith the electronic fault detecting circuitry and circuit breaker. This space limitation has resulted in considerable difficulty in the design and manufacture of receptacle model GFCI devices and has appreciably contributed to the cost of the devices.

SUMMARY OF THE PRESENT INVENTION

The duplex receptacle model GFCI device of the present invention is constructed and arranged in a manner to require a minimum of parts and labor to assemble, and the device is electrically and physically sound. In the construction of devices of this invention, two rigid, preformed bus conductors of relatively flat, metal are insertable edgewise in the cover case of the receptacle model device and provide respective electrical connections between the two "hot" and neutral female receptacle connectors of the duplex device. The preformed bus conductors are formed in a generally U-shaped configuration and one bus connector nests within the U-shaped configuration of the other one, thereby eliminating the need for one bus conductor to cross over the other. This arrangement greatly reduces the number of weld or solder connections that must be madeduring manufacture of the device. The preformed bus conductors also include as an integral part thereof, respective female clip receptacles for the two plug receptacles and a stationary contact for the circuit breaker.

The GFCI electronic circuitry is potted within a dielectric plastic material to form an integral module which is retained in a separate compartment of the device. The device has three wires emanating from it. The wires connect, respectively, to the hot, neutral and ground conductors of the electrical supply system.

Upon detection of a fault in an electrical circuit connected to one of the plug receptacles of the device, the GFCI circuitry produces a fault signal which energizes the solenoid of the circuit breaker within the receptacle device. The solenoid actuates a trip mechanism which opens contacts to the hot and neutral bus conductors of the device, thus disconnecting the two plug receptacles from the electrical source.

DETAILED DESCRIPTION

Figure 1:
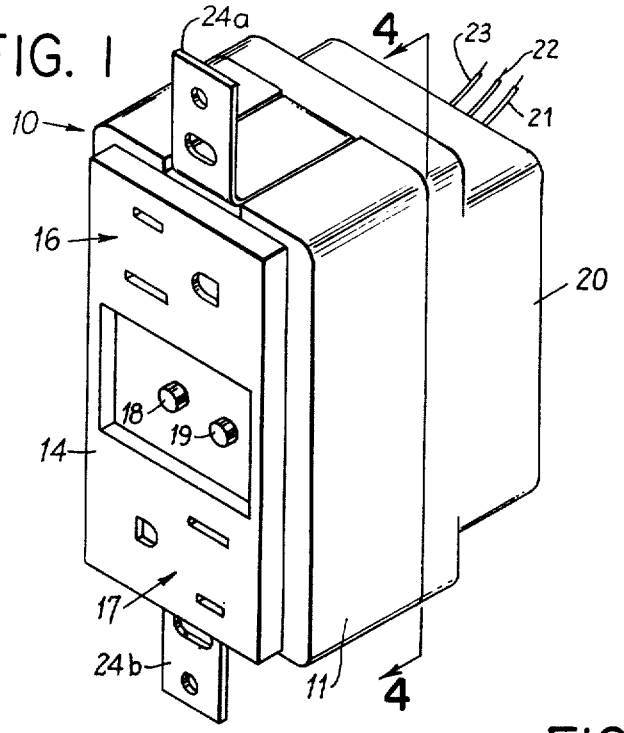
FIG. 1 is a perspective view of a duplex receptacle model GFCI constructed in accordance with the present invention.

In the perspective view of FIG. 1 the duplex receptacle GFCI device 10 is comprised of a molded plastic front case 11 which is a hollow five-sided rectangular member. The face 14 of front case 11 has two sets of spaced slots or apertures which comprise receptacles 16 and 17 for respectively receiving the three prongs of male plugs. Reset button 18 and test button 19 extend outward through front face 14.

It will be noted, and it will be explained below, that the two patterns of apertures for receptacels 16 and 17 are angularly oriented 180° with respect to each other.

A molded plastic back case 20 is attached by screws or rivets to the back side of front case 11. Back case 20 is a hollow rectangular member which encloses within it a potted module which comprises the electronic circuitry of the ground fault sensor. As used herein, ground fault sensor, or ground fault current interrupter, GFCI, may or may not include circuitry for detecting a ground connection on the load side of the neutral conductor. This invention does not involve the details of the ground fault sensing circuit itself, and accordingly, any known type of circuitry may be employed in the device of this invention.

Electrical leads 21, 22, 23 extend outwardly from apertures in back case 20 and constitute, respectively, the hot, neutral and ground conductors which are to be connected to corresponding conductors of the electrical supply system.

Mounting brackets **24*a* and 24*b*** are provided for mounting the receptacle device in a wall box.

Figure 2:
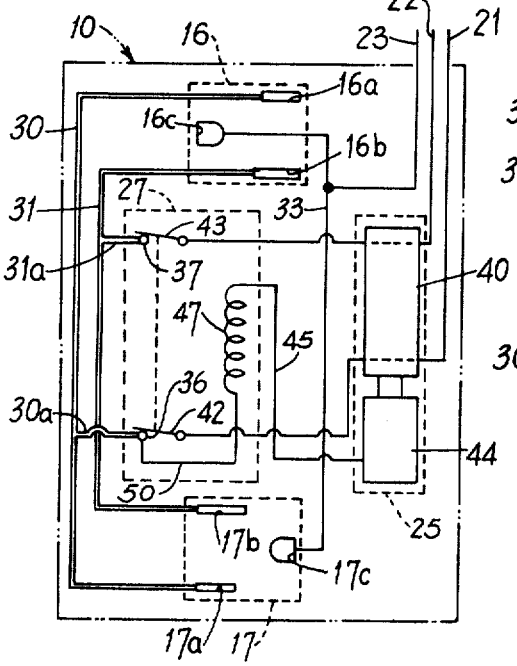
FIG. 2 is a simplified wiring diagram of a device constructed in accordance with the present invention.

FIG. 2 is a simplified wiring diagram of the device 10 and shows hot, neutral and ground conductors 21, 22 and 23 leading into the case. Included within the device 10, and shown within respective broken line rectangles, are the potted module 25 of the GFCI circuitry and a two pole electromagnetic circuit breaker 27 which may be of conventional design.

A preformed, generally U-shaped, hot bus conductor 30 of relatively thick and rigid, flat conductive material electrically connects the female clip connectors 16*a* and 17*a* of receptacles 16 and 17, and a similarly shaped and constructed, but somewhat shorter neutral bus conductor 31 electrically connects the female clip receptacles 16*b* and 17*b*. The bus conductors 30 and 31 will be described in further detail below. The ground clip receptacles 16*c* and 17*c* are electrically connected by conductor 33 which may be a conventional wire conductor. The hot and neutral bus conductors 30 and 31 have formed as an integral and unitary part thereof the short branch conductors 30*a* and 31*a*. Stationary contacts 36 and 37 of circuit breaker 27 are respectively secured to the free ends of branch conductors 30*a* and 31*a*.

Hot and neutral lead wires 21 and 22 pass through a toroid transformer 40 in the potted module 25 and then connect to the respective movable contacts 42 and 43 of circuit breaker 27.

A fault signal produced in the GFCI electronic circuitry 44 within potted module 25 is coupled over lead 45 to solenoid 47 of the circuit breaker. The other end of solenoid 47 is coupled by lead 50 to branch conductor 30*a* of hot bus conductor 30.

Figure 4:
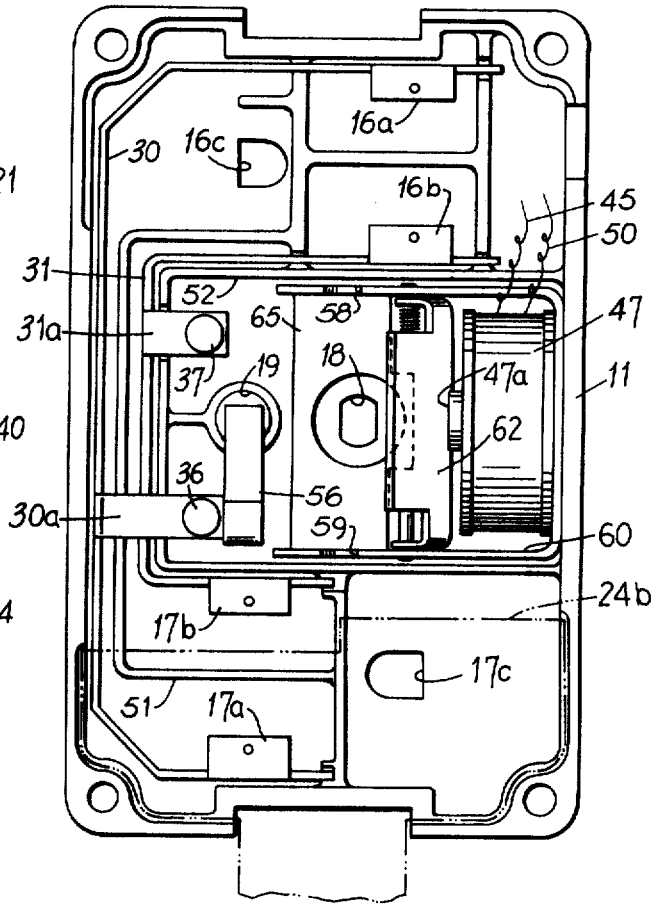
FIG. 4 is a plan view looking into the back of the front case of the device of FIG. 1.
Figure 3:
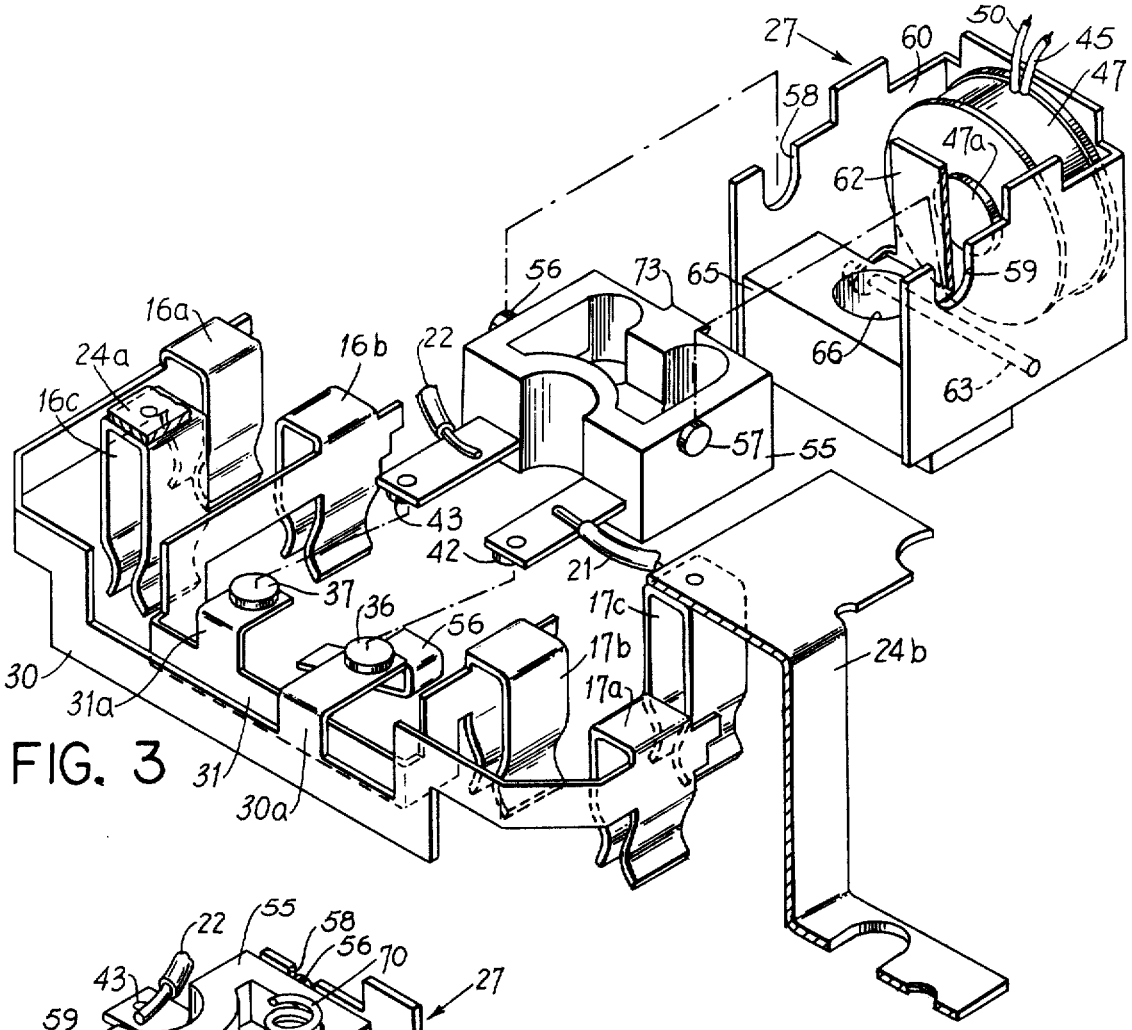
FIG. 3 is a simplified and partially exploded perspective illustration of the bus conductors and the major portion of the circuit breaker of a device of this invention.

The physical configuration of preformed bus conductors 30 and 31 and their positioning relative to one another and relative to circuit breaker 27 are shown in the simplified illustration of FIG. 3. The positioning of those components within front case 11 is illustrated in FIG. 4, which is a view looking into the back of front case 11, and assuming that back case 20 is removed. Referring to both of those figures, it is seen that the inside of the plastic front cover 11, FIG. 4, has molded therein a number of partition walls such as walls 51 and 52 which are of various heights but none of which are the full height of the outer side walls of front case 11. Hot bus conductor 30 generally has a U-shaped configuration comprised of two side legs joined by a crossover portion. The bottom one of the side legs is shorter than the other one. Adjacent the outer ends of each of the two legs of hot bus conductor 30 are female clip receptacles 16*a* and 17*a*, FIG. 3, which are preformed from the same stock material as the bus conductor. At the crossover portion of bus conductor 30 branch conductor 30*a* rises vertically a short distance and then bends over and extends substantially horizontally a short distance. Bus conductor 30, female clip receptacles 16*a* and 17*a*, and branch conductor 30*a* all are fashioned from a unitary sheet of relatively thick, flat conductive material so that no welding or soldering is required for this rigid, integral, preformed member. Contact head 36 of the circuit breaker is secured at the outer extremity of branch conductor 30*a*.

Neutral bus conductor 31 also is of a generally U-shaped configuration but its two legs and crossover portion therebetween are somewhat shorter than corresponding portions of bus conductor 30 so that neutral bus conductor 31 nests within the configuration of hot conductor 30. As seen in FIG. 4, the crossover portions of the two bus conductors 30 and 31 are parallel and relatively closely spaced. A U-shaped partition wall 51 within plastic front cover 11 extends between the flat sides of the two bus conductors to help maintain them in position and electrically insulated from each other. A second U-shaped partition wall 52 is on the inside of neutral bus conductor 31 to help maintain that conductor in position. Branch conductor 31*a* passes over the top edge of the crossover portion of partition wall 52 and supports at its outer end a stationary contact 37 of circuit breaker 27.

Because bus conductors 30 and 31 are shaped so that they may be inserted edgewise into respective slots formed by a side wall and the two partition walls 51 and 52 the bus conductors may be nested closely adjacent each other and thus require a minimum of valume within front case 11. As seen in FIG. 4, the free ends of bus conductors 30 and 31 are received in corresponding supports formed in molded front case 11.

Figure 5:
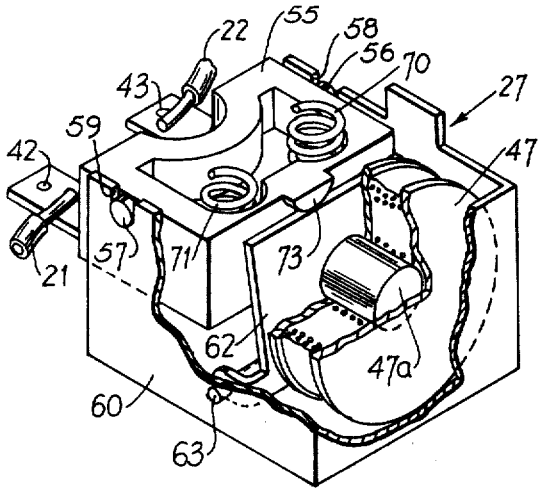
FIG. 5 is a simplified perspective illustration, partially broken away, of the circuit breaker portion of a device of this invention.

As seen in FIGS. 3 and 5, but not illustrated in FIG. 4 in order not to obscure other parts of that figure, movable contacts 42 and 43 of the circuit breaker 27 and disposed at the outer ends of arms that are held within a pivot member 55 which is made of a dielectric plastic material. Pivot pins 56 and 57 extend from opposite sides of pivot member 55 and are received within open recesses 58 and 59 formed in the upper edge of a U-shaped bracket 60 which forms the frame of the circuit breaker 27. Solenoid 47 is affixed to the crossover portion of bracket 60. A flat armature 62 is pivotally supported on a pin 63 which extends between the side legs of bracket 60. A plastic block 65 also extends between the side legs of bracket 60. Block 65 has an aperture 66 extending therethrough within which circuit breaker reset button 18 is located, see FIGS. 1 and 4.

As illustrated in FIG. 5, pivot member 55 has a cavity in its top surface for receiving helical springs 70 and 71. When assembled as illustrated in FIG. 1, the top ends of helical springs 70 and 71 of FIG. 5, are held in compression against a removable cover plate of back case 20. The springs therefore tend to rotate pivot member 55 in a clockwise direction about pivot pins 56 and 57, thus tending to move the circuit breaker contacts 36, 37 and 42, 43 to the open contacts position, see FIG. 3. In the set condition of the circuit breaker 27, flat armature 62 is spring biased in a counterclockwise direction about its pivot pin 63, and its upper edge is held against the bottom surface of a detent 73 formed on pivot member 55. In the set arrangement just described the circuit breaker contacts 36, 37 and 42, 43 will be in their contacts closed position.

To set circuit breaker 27 to the contacts closed condition, reset button 18 on the face 14 of front cover 11 is pressed inwardly. Button 18 engages the back portion of pivot member 55 and raises its back edge to allow spring biased flat armature 62 to come into engagement with the bottom of detent 73.

Upon occurrence of a fault signal, solenoid 47 is energized and flat armature 62 is attracted toward solenoid core 47*a*, thereby moving out of contact with detent 73 on pivot member 55. Compression springs 70 and 71 then cause pivot member 55 to rotate in a clockwise direction to disengage movable contacts 42 and 43 from stationary contacts 36 and 37, thus disconnecting the hot and neutral bus conductors 30 and 31 from the hot and neutral leads 21 and 22 of the electrical supply system.

As seen in FIG. 4 a short, resilient conductive strip 56 is secured to the free end of branch conductor 30*a*. This strip 56 is in contact with the bottom end of test button 19. Although not illustrated since it forms no part of the present invention, a contact extends from back cover 20 into closely spaced relationship to the free end of strip 56. The nonillustrated contact connects to a test resistor in the GFCI circuitry within back case 20. To test the operation of the GFCI device, the circuit breaker is set and test button 19 is pressed to close a test circuit which connects the input neutral line 22 and hot bus conductor 30. This represents a short circuit across the lines and should produce a fault signal in the GFCI circuit.

From the preceding description it is seen that the duplex receptacle model GFCI is relatively simple to manufacture and assemble. One of the advantageous features of the device is that the hot and neutral bus conductors 30 and 31 include the short branch conductors 30*a* and 31*a* for supporting contacts 36 and 37, and also include a integral parts thereof the clip receptacles 16*a*, 17*a* and 16*b*, 17*b*, respectively. Additionally, by arranging the plug recpetacles 16 and 17 so that the receptacle clips of the two are angularly oriented 180° with respect to each other it is possible to form the bus conductors 30 and 31 in U-shaped configurations and to nest one within the other in front case 11. This eliminates the necessity for one bus conductor to pass over or under the other and reduces the number of welds and/or solder connections and joints, thus greatly simplifying the manufacture and assembly of the devices. The assembly of devices constructed in accordance with this invention is relatively simple. The bus conductors 30 and 31 are merely inserted on edge within closely fitting slots or channels formed by a side wall and the U-shaped partition walls 51 and 52 which are molded into the front case 11. Short tabs on the free ends of the bus conductors rest on corresponding supports also molded into front case 11, thus further supporting and positioning the bus conductors.

Figure 6:
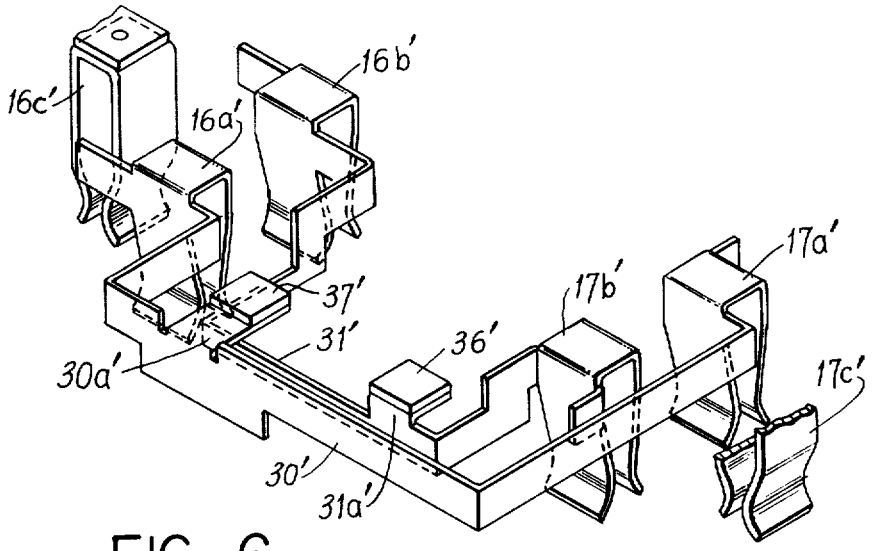
FIGS. 6 and 7 are simplified perspective and plan views, respectively, showing an alternative construction and arrangement of bus conductors for a duplex receptacle model GFCI constructed in accordance with the present invention.
Figure 7:
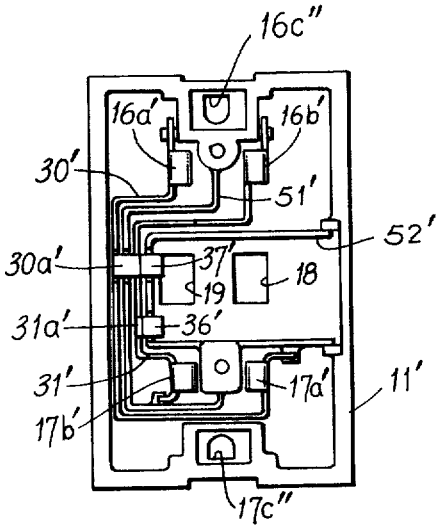

The concept of the present invention is not limited to the exact configuration and arrangement illustrated in FIGS. 1–5. Another embodiment of the invention is illustrated in FIGS. 6 and 7. In these figures, parts corresponding to those of the embodiment of FIGS. 1–5 have corresponding primed reference numerals.

In FIGS. 6 and 7 it is seen that bus conductors 30' and 31' also are preformed from flat, relatively rigid conductive stock material and each has a generally U-shaped configuration. In this arrangement the receptacle clips 16*c'* and 17*c'* for the ground pin of the male plugs are centered mid way between the side walls of the case and are positioned above and below, respectively, the hot and neutral receptacle clips. In other words, the pairs of hot and neutral clip receptacles 16*a'*, 16*b'* and 17*a'*, 17*b'* are adjacent each other on a line parallel to the narrow side wall of front case 11' while in the first embodiment, see FIG. 4, the pairs of clip receptacles 16*a*, 16*b* and 17*a*, 17*b* are adjacent each other on respective lines that are parallel to the longer side walls of the front case 11. It will be seen that the bus conductors 30' and 31' illustrated in FIGS. 6 and 7 otherwise are quite similar to the bus conductors 30 and 31 illustrated in FIGS. 3 and 4.

In FIG. 7 the clip receptacles for the ground wire pin of male plugs have not been illustrated, but the corresponding apertures 16*c''* and 17*c''* in the front face of case 11' have been illustrated.

While the invention has been illustrated and described in its perferred embodiments, other embodiments may be made without departing from the concept of the invention and without departing from the scope of the accompanying claims.

What is claimed is:

1. In a receptacle model ground fault circuit interrupter device, wherein said device includes at least first and second electrical plug receptacles and circuit breaker means for disconnecting said receptacles from an electrical source, and further includes ground fault circuit interrupting means for actuating said circuit breaker means upon sensing a ground fault, improved means for electrically connecting said receptacles in parallel and connecting the parallel connected receptacles to said circuit breaker means, said improvement comprising a case having four side walls and a front face, first and second spaced receptacle means ins said front face for receiving prongs of at least two male electrical plugs, first and second preformed bus conductors of generally U-shaped configuration disposed within said case, said bus conductors being preformed from relatively rigid and flat stock metal, each bus conductor having two legs with a crossover portion therebetween, the crossover portion of the second bus conductor being shorter than that of the first one, insulating partition means within said case for holding said first bus conductor in a fixed position with its crossover portion adjacent one side wall of the case, additional insulating partition means within the case for holding the second bus conductor in a fixed position nested at least partially within said first bus conductor with the crossover portions of the two bus conductors closely adjacent and substantially parallel, a pair of female clip receptacles located, respectively, adjacent the free ends of the two side legs of each bus conductor, said free ends of the two bus conductors and said clip receptacles being constructed and arranged to receive prongs of electrical male plugs inserted through said receptacle means in said front face.

2. The combination claimed in claim 1 wherein said receptacle means in said front face comprises first and second sets of apertures through said front face, said two sets of apertures being angularly oriented 180° with respect to each other.

3. The combination claimed in claim 1 wherein said case is a molded plastic case and wherein said two insulating partition means are integral an unitary portions of said molded case and extend normally from the back surface of said front face.

4. The combination claimed in claim 3 wherein said two insulating partition means are relatively thin U-shaped partitions, the crossover portion of the first U-shaped partition being spaced from said one side wall of the case to hold the crossover portion of the first bus conductor on edge therebetween, the crossover portion of said second U-shaped insulating portion being spaced from that of the first insulating partition to hold the crossover portion of said second bus conductor on edge therebetween.

5. The combination claimed in claim 1 and further including first and second preformed branch conductors extending, respectively, from the crossover portions of the first and second bus conductors, contact means on said branch conductors for making and breaking with movable contacts of said circuit breaker means.

6. The combination claimed in claim 5 wherein said branch conductors extend transversely from the bus conductors and are bent to extend in the direction parallel to said side legs.

7. The combination claimed in claim 5 wherein each of said bus conductors and its associated clip receptacles and branch conductors are preformed as an integral unit from a unitary sheet of flat stock metal.

8. In a duplex receptacle model ground fault circuit interrupter device for mounting in a duplex receptacle wall box, the combination comprising a front cover member comprised of four side walls and a front wall, two sets of three apertures in said front wall defining two plug receiving means for receiving three-pronged electrical plugs, two apertures of each set adapted to receive plug prongs corresponding to hot and neutral conductors, and the third aperture adapted to receive a third prong corresponding to a ground conductor, said two sets of apertures being arranged in patterns that are angularly oriented 180° relative to each other, a first relatively rigid bus conductor preformed in a generally U-shaped configuration disposed within said front cover, the crossover portion of the U-shaped first bus conductor being disposed along one of said side walls of the front cover, first and second female clip receptacles disposed adjacent the free ends of the two legs of the first bus conductor, said two clip receptacles being preformed unitary and integral parts of said bus conductor, a branch conductor extending transversely from the crossover portion of said bus conductor, said branch conductor being a performed unitary and integral part of said first bus conductor, stationary contact means affixed to said branch conductor, a second relatively rigid bus conductor preformed in a generally U-shaped configuration and disposed within said front cover, the crossover protion of said second bus conductor being shorter in length than that of the first bus conductor, the second bus conductor being disposed in nested, spaced relationship with respect to the first bus conductor and with its crossover portion substantially parallel to that of the first bus conductor, one side leg of the second bus conductor being shorter than the other side leg, third and fourth female clip receptacles disposed adjacent the free ends of the two legs of the second bus conductor, said third and fourth clip receptacles being preformed unitary and integral parts of said second bus conductor, a second branch conductor extending transversely from the crossover portion of said second bus conductor and disposed in spaced relationship to said first branch conductor, said second branch conductor being a preformed unitary and integral part of the second bus conductor, a second stationary contact affixed to said second branch conductor, said first and second clip receptacles being constructed and arranged to be in registration with and thereby receive the same hot or neutral prongs of corresponding electrical plugs inserted through the two sets of apertures in said front wall of the front cover member, said third and fourth clip receptacles being constructed and arranged to be in registration with and thereby receive the other ones of the hot or neutral prongs of electrical plugs inserted through the two sets of apertures in said front wall of the cover case, fifth and sixth female clip receptacles disposed in said front cover member and each constructed and arranged to be in registration with and thereby receive a corresponding ground prong of an electrical plug inserted through said front wall, circuit breaker means within said four side walls and including two movable contacts for cooperating with said first and second contacts on said branch conductors to provide circuit breaker action therebetween, a back cover member adapted to mate with said front cover member, ground fault sensing circuit means within said back cover member, means coupling a ground fault signal from said sensing circuit means to said circuit breaker means, hot an neutral conductors extending from the exterior of said device and coupled to the movable contacts of the circuit breaker means and to said ground fault sensing circuit means.

9. The combination claimed in claim 8 and further including, insulating partition means formed as part of said front cover means and disposed between said two bus conductors for maintaining said two bus conductors on edge in fixed spaced relationship to each other.

10. The combination claimed in claim 9 wherein said first branch conductor of the first bus conductor extends parallel to a surface of said partition means and then extends transversely across said partition means and said second bus conductor.

11. The combination claimed in claim 10 wherein said first and second preformed bus conductors have widths considerably greater than their thicknesses and have a U-shaped configuration looking edgewise at the thickness dimension.

12. The combination claimed in claim 11 wherein said crossover portions of the two bus conductors are disposed closer said front wall of the front cover member than are the side legs thereof.

13. In a duplex receptacle model ground fault circuit interrupter device, the combination comprising a plastic case having four side walls and a front face to form a five-sided case, said front face being characterized by having at least three adjacent regions thereon, first and second sets of apertures respectively located in two of said regions on the front face, the apertures of each set being adapted to receive the prongs of an electrical male plug and the pattern of apertures of one set being angularly oriented 180 with respect to that of the other set, an insulating partition having a U-shaped configuration extending normally from the back surface of said front face, the crossover portion of the U-shaped partition being closely adjacent one side wall of said case and the two legs of the partition extending transversely between two side walls, siad insulating partition defining three side-by-side sections within said case, the end ones of the three sections being in registration with a respective set of apertures in said front face, a second U-shaped insulating partition extending normally from the back surface of the front face, the crossover portion of the second partition being disposed parallel to and closely spaced from the crossover portion of the first partition on the side thereof opposite said one wall of the case, the side legs of the second partition extending in parallel spaced relationship to the side legs of the first partition, first and second preformed bus conductors of generally U-shaped configuration when viewed edgewise, said bus conductors being preformed from relative rigid and flat stock metal, each U-shaped bus conductor having one side leg shorter than the other side leg, said second bus conductor having a shorter crossover portion than that of the first bus conductor, said first bus conductor being inserted edgewise within said case with its crossover portion disposed between said one side wall and said first insulating partition and with each side leg in a respective end section within said case, said second bus conductor being inserted edgewise within said case with its shorter crossover portion disposed between the crossover portions of the two insulating partitions and having each side leg within a respective end section within said case, the side legs of said two bus conductors being substantially parallel, whereby the second bus conductor nests within the first bus conductor with no crossovers therebetween, a female clip receptacle disposed at the free end of each side leg of each of said bus conductors, said clip receptacles being located in registration with a corresponding aperture in said front face.

* * * * *